United States Patent [19]

Ridley

[11] 4,047,760

[45] Sept. 13, 1977

[54] IN SITU RECOVERY OF SHALE OIL

[75] Inventor: Richard D. Ridley, Grand Junction, Colo.

[73] Assignee: Occidental Oil Shale, Inc., Grand Junction, Colo.

[21] Appl. No.: 636,227

[22] Filed: Nov. 28, 1975

[51] Int. Cl.[2] ..... E21B 43/24; E21B 43/26; E21C 41/10

[52] U.S. Cl. ..... 299/2; 166/259

[58] Field of Search ..... 166/247, 256, 259, 302, 166/303; 299/2

[56] References Cited

U.S. PATENT DOCUMENTS

| | | | |
|---|---|---|---|
| 1,919,636 | 7/1933 | Karrick | 299/2 |
| 3,316,020 | 4/1967 | Bergstrom | 166/259 X |
| 3,342,257 | 9/1967 | Jacobs et al. | 166/247 |
| 3,533,469 | 10/1970 | Parker | 166/247 X |
| 3,618,663 | 11/1971 | Needham | 166/247 |
| 3,661,423 | 5/1972 | Garret | 299/2 |

FOREIGN PATENT DOCUMENTS

| | | | |
|---|---|---|---|
| 785,583 | 5/1968 | Canada | 166/247 |

OTHER PUBLICATIONS

Lekas et al., Fracturing Oil Shale with Nuclear Explosives for In-Situ Retorting, Quarterly of the Colorado School of Mines, July, 1965, pp. 7-30.

*Primary Examiner*—Stephen J. Novosad
*Assistant Examiner*—George A. Suchfield
*Attorney, Agent, or Firm*—Christie, Parker & Hale

[57] ABSTRACT

An in situ oil shape retort is provided in a subterranean oil shale formation. An inlet gas access is provided to an end of the in situ retort through which gas is supplied to initiate and advance a retorting zone through the in situ retort for converting kerogen in the oil shale to liquid and gaseous products. A zone of fragmented oil shale fills the in situ retort and extends from the inlet gas access means to the product recovery end of the in situ oil shale retort. The zone of fragmented oil shale has a length from the inlet gas access means to the product recovery end of the in situ retort in the range of from about two to five times the width of the zone of fragmented oil shale and an average void fraction of about 10 to 25 percent of the volume of the zone of fragmented oil shale. In a preferred embodiment the in situ retort is vertical with a height between two and three times its width and the average void fraction is about 15%.

20 Claims, 2 Drawing Figures

IN SITU RECOVERY OF SHALE OIL

BACKGROUND OF THE INVENTION

This invention relates to the recovery of liquid and gaseous products from subterranean oil shale formations and, more particularly, to the in situ production of shale oil from oil shale.

One technique for recovering shale oil is to form an in situ retort in a subterranean oil shale formation. The retort is in the form of a cavity in essentially undisturbed oil shale filled with fragmented oil shale. The cavity and bed of fragmented shale therein can be formed by mining and blasting. The fragmented oil shale at the top of the in situ retort is ignited to establish a combustion zone at the top of the in situ retort, and the combustion zone is advanced slowly down through the fragmented oil shale by passing gas downwardly through the in situ retort. The heat generated in the combustion zone is transferred the fragmented oil shale below the combustion zone to establish a retorting zone on the advancing side of the combustion zone wherein kerogen in the fragmented oil shale is converted to shale oil and other liquid and gaseous products. Thus, an elevated temperature retorting zone moves from the top to the bottom of the in situ retort in advance of the combustion zone, and the resulting shale oil passes to the bottom of the in situ retort for recovery.

In the described recovery process, it is desirable that the retorting zone move as a horizontal plane wave down through the in situ retort. If the combustion zone becomes significantly skewed, shale oil released in the lagging region of the retorting zone may be destroyed in the leading region of the combustion zone, thereby reducing the yield of the shale oil from the in situ retort. It is also important that the fragmented shale within the in situ retort present a low resistance to gas flow therethrough, otherwise the inlet gas introduced at the top of the in situ retort would be under high pressure which would consume an excessive amount of energy to compress the inlet gas sufficiently to move it from the top to the bottom of the in situ retort. The resistance to flow depends upon the void volume or void fraction of the in situ retort and the height of the in situ retort.

SUMMARY OF THE INVENTION

An in situ oil shale retort is provided which minimizes end effects and minimizes the requirement for intact pillars of oil shale in a subterranean formation thereby enhancing recovery from the total reserve. The in situ retort is in the form of a cavity in the oil shale formation containing fragmented oil shale having an average void fraction in the range of from about 10 to 25 percent. The in situ retort preferably has a height to width ratio in the range of from about two to five. Means are provided at the top for introducing retorting gas. Means are provided at the bottom for recovering gaseous and liquid products resulting from conversion of kerogen during retorting.

As a method the invention is practiced by forming an in situ retort in a subterranean oil shale formation. The in situ retort is formed with a zone of fragmented oil shale having a length in the range of from about two to five times its width and a void fraction in the fragmented oil shale in the range of from about 10 to 25 percent. Retorting gas is introduced at one end of the in situ retort to advance a retorting zone through the fragmented oil shale and liquid and gaseous products are recovered at the other end.

DRAWINGS

Features of a specific embodiment of the invention are illustrated in the drawing, in which:

FIG. 1 is a side sectional view of a portion of a subterranean oil shale formation having a plurality of in situ oil shale retorts; and FIG. 2 is a bottom sectional view of the formation of FIG. 1.

DETAILED DESCRIPTION

Figure 1:
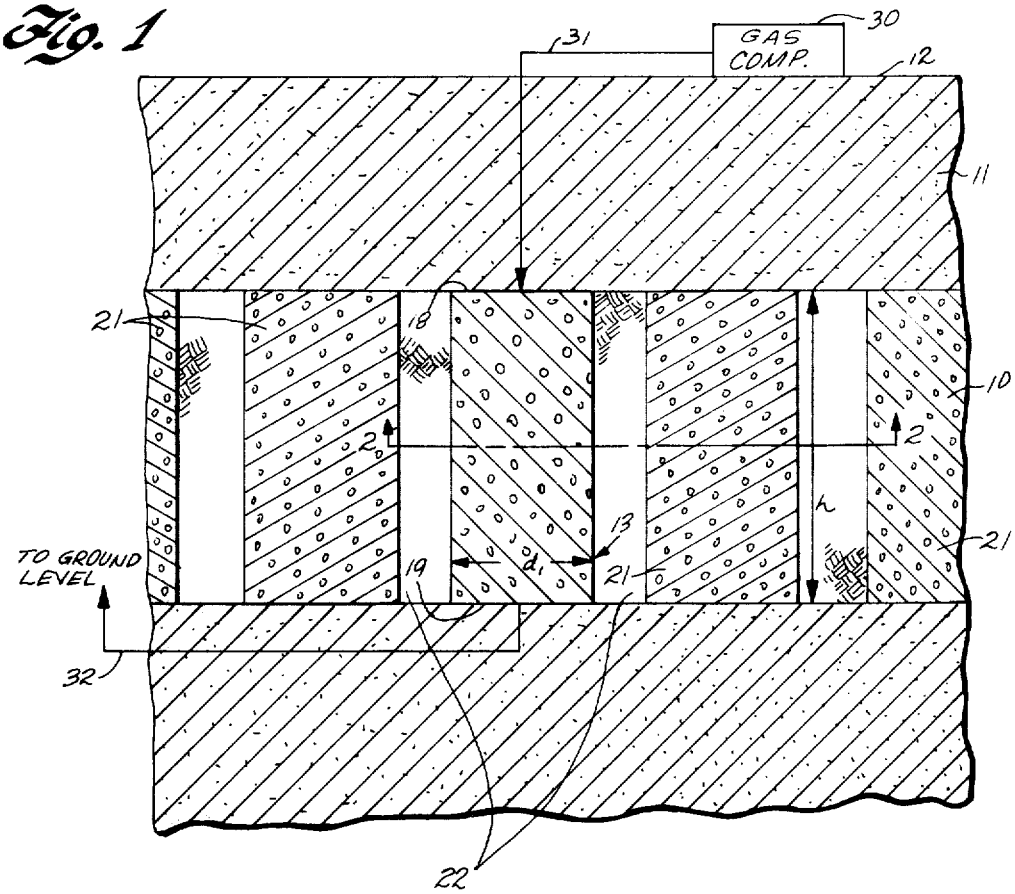
Figure 2:
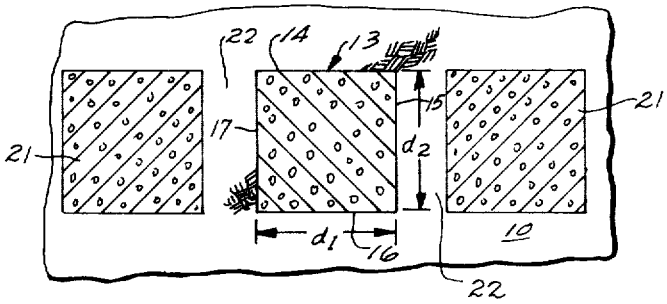

In the drawings are shown a subterranean oil shale formation 10, an overburden 11, and ground level at 12. An in situ retort 13 within the deposit 10 comprises a zone of fragmented oil shale in a cavity in essentially undisturbed oil shale. In this embodiment, the in situ retort 13 has flat vertical side boundaries 14, 15, 16, and 17, top boundary 18, and a bottom boundary 19. The fragmented shale in the in situ retort 13 has a void volume of less than about 25 percent of the volume of the in situ retort so as to maximize the amount of oil shale in the in situ retort. A void fraction greater than 25 percent unduly increases the cost of preparing in situ retort 13, because of the additional shale that would have to be removed, and further there is a decrease in the total shale oil yield. Preferably, the void volume of in situ retort 13 is about 15 percent of the volume of the in situ retort.

The in situ retort is in a matrix of similar in situ retorts 21. Each in situ retort is separated from the adjacent in situ retort by pillars 22 of substantially intact oil shale. The pillars between adjacent in situ retorts may be fractured to some extent but are not fragmented so there is not high permeability through the pillars. Any shale oil formed by decomposition of kerogen in the pillars diffuses through the pillars to the in situ retort for collection. Preferably, the pillars are relatively thin so that heat and shale oil have an opportunity to diffuse therethrough for maximizing yield from the oil shale formation.

Different techniques may be used to fragment the oil shale and control the void volume of the in situ retort. Techniques for fragmenting oil shale while controlling the void fraction are disclosed in application Ser. No. 464,957, filed Apr. 29, 1974, now abandoned, by Gordon B. French, entitled "Multiple Zone Oil Shale Retorting for Controlled Void Volume Distribution" and in application Ser. No. 505,457, filed Sept. 12, 1974, now abandoned, by Gordon B. French, entitled "Method for Fragmenting Ore for In Situ Recovery of Constituents". The disclosure of these applications are incorporated herein by reference. In both applications, oil shale is excavated from a subterranean oil shale formation to form an open space, and the oil shale adjacent to the open space is explosively fragmented and expanded into the open space in one or more sequential steps to form a permeable zone of fragmented oil shale. In one embodiment, the open space is a horizontal room having dimensions corresponding to the horizontal cross section of the in situ retort, and the shale above the room is explosively expanded downwardly into the room. In another embodiment, the open space comprises a vertically extending raise that extends through the volume to become the in situ retort. The oil shale around the raise is expanded inwardly by the sequential detonation of explosives in rings of blast holes drilled parallel to and surrounding the raise. Regardless of the technique used, the void volume of the open space should be sufficiently large to fragment all the shale within the in situ retort 13, rather than merely fracture it, otherwise, the resistance to air flow through the in situ retort would be too great for practical operation.

In the drawing, the vertical dimension between the top boundary 18 and the bottom boundary 19, is designated *h*, the width of the in situ retort 13 between side boundries 15 and 17 i.e., the lateral dimension between side boundaries 15 and 17 is designated $d_1$, and the width of in situ retort 13 between side boundaries 14 and 16, i.e., the lateral dimension between side boundaries 14 and 16 is designated $d_2$. In the specific embodiment shown, side boundaries 14 through 17 define a square transverse cross section, i.e., dimensions $d_1$ and $d_2$ are equal, and top boundary 18 and bottom boundary 19 are both horizontal, i.e., dimension *h* is uniform throughout in situ retort 13.

A gas compressor 30 at ground level is coupled by one or more conduits represented by a lead line 31 to one or more inlet gas access means distributed about the top of the in situ retort 13. Because of the high permeability of the zone of fragmented oil shale in the retort, compressor 30 need only deliver inlet gas at low pressure to move the inlet gas from the top to the bottom of the in situ retort, i.e., at about 5 psi, or less, which does not require much power. The disclosure of U.S. Pat. No. 3,661,423, which issued May 9, 1972, to Donald E. Garrett, and is assigned to the assignee of the present application, is incorporated herein by reference. As described in this patent, the oil shale at top boundary 18 is ignited to establish a combustion zone. The compressor 30 supplies air or other combustion supporting gas for maintaining the combustion zone within the in situ retort, and for advancing the combustion zone slowly downwardly toward the bottom boundary 19. As carbonaceous material in the oil shale burns in the combustion zone, gas moving through the combustion zone transfers the heat of combustion to the oil shale below the combustion zone to establish a retorting zone on the advancing side of the combustion zone wherein kerogen in the retorting zone is converted to liquid and gaseous products. Thus, a retorting zone moves from the top to the bottom of the in situ retort in advance of the combustion zone, and the resulting liquid and gaseous products pass to the bottom of the in situ retort for collection and recovery in a product recovery zone connected to the bottom of in situ retort 13. A variety of control and recovery devices can be employed in the product recovery zone at the bottom such as gas and liquid pumps, valves, gas-liquid separators and the like. Since these can be conventional they are not described in detail herein. As represented by a lead line 32, shale oil and gases collected at the bottom are recovered and transported to ground level.

It is important that the combustion zone move through in situ retort 13 as a plane wave substantially normal to the longitudinal axis of the in situ retort. This requires that the gas flow rate through in situ retort 13 from top to bottom have horizontal uniformity, that is, have generally similar flow in all portions of a horizontal plane through the retort. If the flow rate through one region of the in situ retort from top to bottom is higher than the flow rate through the remainder of in situ retort, the combustion zone advances faster through the one region than through the remainder of the in situ retort, and the combustion zone becomes skewed, i.e., non-horizontal, or non-planar. As a result, the shale oil released from the retorting zone in the portion of the in situ retort where the combustion zone lags may be destroyed in an adjacent portion of the combustion zone where the combustion zone has advanced below the retorting zone. Such destruction of shale oil is highly undesirable because it reduces the yield of shale oil from the in situ retort.

The ends of the in situ retort present most of the problems of gas flow uniformity through the in situ retort; thus, for example, when a single conduit 21 is used for introducing inlet gas through an access means at the top of the in situ retort 13, there is localized heating in the shale near the conduit when the combustion zone is initiated through the conduit, and regions near the sides of the in situ retort may not be adequately heated for recovering shale oil therefrom. A similar end effect may be present at the product recovery end of the in situ retort where retort off gas is withdrawn. As the retorting zone moves through the in situ retort away from the inlet gas access end, it tends to become more planar and more nearly approaches optimum retorting efficiency. It is therefore desirable to minimize the effects of the ends by making the ratio of in situ retort length to width relatively high. As the length of the in situ retort is increased, the effects by the ends are decreased. When the length of the in situ retort is less than about twice the width of the in situ retort, the end effects are significant and unduly reduce shale oil yield from the in situ retort. Such reduced length also reduces the time available for heat to diffuse into the pillars between in situ retorts and yield therefrom may also be reduced.

According to this invention, uniformity of gas flow from end to end of the in situ retort is maintained by forming the in situ retort so its largest longitudinal dimension *h* is greater than two times its largest lateral dimension $d_1$ or $d_2$. The largest longitudinal dimension of the in situ retort represents the height of the in situ retort while the largest lateral dimension of the in situ retort represents the width of the in situ retort. The less the largest longitudinal dimension *h* is relative to the largest lateral dimension $d_1$ or $d_2$, the higher the effect of distortion of the retorting zone at the ends and the poorer is the overall yield from the in situ retort.

The largest longitudinal dimension of the in situ retort should be limited so that the pressure required to move gas through the zone of fragmented oil shale from the inlet gas access means to the product recovery end of the in situ retort does not exceed about 10 psig with the gas being moved through the zone of fragmented oil shale at about 1 to 2 Standard Cubic Feet of gas per square foot of cross-sectional area of the in situ retort per minute. If the pressure is greater than about 10 psig, the energy requirements for moving gas through the in situ retort become excessive and gas permeability of unfragmented shale adjacent the recovery zone permits excessive gas leakage. Such leakage represents wasted energy.

In a vertically extending in situ oil shale retort, substantially intact pillars 22 of unfragmented oil shale are left between adjacent in situ retorts. These pillars of oil shale support overburden 11 above the in situ retort as well as over the pillars. They also act as gas barrier between adjacent retorts. When the in situ retort is full of fragmented oil shale, there is also support for the overburden by the fragmented oil shale in the in situ retort. The ability of the pillars to support overburden depends on their compressive strength when the pillars are relatively short and thick.

As the pillars become long or tall, adjacent tall in situ retorts, shear loading becomes of more concern and the properties of the fragmented oil shale in the in situ retort becomes a strong influencing factor. It is preferable to have the pillars as thin as possible so that heat from the in situ retort recovers shale oil from the pillars, maximizing the total yield of shale oil from the in situ retort. If the pillars are excessively thick, the heat will not diffuse deeply enough and a portion of the oil shale in the pillars is not retorted and does not contribute to yield.

Thus, it is desirable to reduce the thickness of the pillars between adjacent in situ retorts which tends to make the shear loading of the pillars between the in situ retorts of more significance. When the void volume of the fragmented shale in the retort is kept low, there is greater lateral support for the pillars and thinner pillars can be left between adjacent in situ retorts. It is therefore particularly preferred that the height to width ratio of a vertical in situ retort be less than about five to one. If the largest vertical dimension of the in situ retort is more than about five times the maximum horizontal dimension, the pillars must be unduly thick to support the overburden, and yield of shale oil from the entire formation is reduced. This occurs since thick pillars may not be completely retorted. The maximum height to width ratio is possible when the void volume is low since the fragmented oil shale in the in situ retort provides better lateral support for the pillars. The preferred average void fraction for providing lateral support for the pillars and for assuring sufficiently low resistance that there is low pressure drop associated with movement of gas through the in situ retort is from about 10 to 25 percent and most preferably about 15 percent of the volume of the in situ retort. If the void fraction is less than about 10 percent, undue resistance to gas flow can be encountered in some oil shale formations. If the void fraction in the fragmented shale is greater than about 25 percent undue amounts of oil shale must be mined. Preferably the void fraction is about 15 percent for good gas flow in all types of shale formations and for giving adequate lateral support to pillars.

It is particularly preferred that the height to width ratio be less than about three, and the void fraction be about 15 percent and no more than about 20 percent. The fragmented shale has some ability to support overburden when the in situ retort volume is filled. A low void fraction enhances the load supporting capability of the fragmented shale. When the height to width ratio is less than about three with a low void fraction the pillars can be minimized and total yield from the reserve enhanced.

By forming the in situ retort with a height to width ratio in the range of from about two to five and a low void fraction the horizontal cross section between adjacent retorts relative to the height of the pillar may be less than sufficient for supporting the entire overburden. The pillars have lateral support from the low void volume fragmented shale and can therefore, accomodate greater loads and the low void volume fragmented shale also supports some of the overburden.

It is preferred that the in situ retort have a vertical longitudinal axis and have a substantially rectangular or square horizontal cross section. This permits "close packing" of adjacent in situ retorts so that there is a minimum amount of unfragmented shale in the pillars between adjacent in situ retorts. Preferably, the largest vertical dimension $h$ is between two and five times greater than the largest horizontal dimension $d_1$ or $d_2$ of a vertical wall of the in situ retort; this permits horizontally uniform gas flow through the in situ retort without reducing the supporting pillars ability to support the overburden 11. It is important that the void fraction in the fragmented oil shale in the in situ retort be kept low so that adequate lateral support is given to the pillars. In one embodiment, the height $h$ is about 250 ft., and the widths $d_1$ and $d_2$ are each about 100 ft. In another embodiment, the in situ retort is about 120 ft. square and the height is about 300 ft. with a domed rather than flat top boundary.

In one embodiment, a vertical in situ retort is provided in a subterranean oil shale formation. The in situ retort is square and has a width of about 32 ft. and a height of about 82 ft. with a flat top boundary and a flat bottom boundary. The inlet gas access to the in situ retort is at about the center of the top boundary. A zone of fragmented oil shale having a void volume of about 15 percent of the volume of the zone of fragmented oil shale fills the in situ retort and extends from the inlet gas access to the bottom of the in situ retort. The cavity filled with fragmented oil shale is formed by excavating about 15 percent of the oil shale within the volume that is to become the cavity. The remaining oil shale is blasted in a single round to form the cavity and simultaneously fill it with fragmented oil shale. A product recovery zone is provided in a tunnel connected to the bottom of the in situ retort. A sump for collecting liquids produced in the in situ retort is provided in the product recovery zone and a bulkhead through which conduits extend to remove liquids from the sump and gases from the product recovery zone is provided in the tunnel.

A combustible gaseous mixture of fuel and air or other oxygen supplying gas is supplied through the inlet gas access means to the top of the in situ retort and ignited to establish a combustion zone at the top of the in situ retort. After the fragmented oil shale in the combustion zone has reached ignition temperatures, combustion is maintained and advanced toward the bottom of the in situ retort by supplying an oxygen supplying gas to the combustion zone. The flue gas from the combustion zone is moved through the in situ retort on the advancing side of the combustion zone to establish a retorting zone on the advancing side of the combustion zone. The kerogen in the retorting zone is converted to liquid and gaseous products as the combustion zone and retorting zone advances through the in situ retort. The products, including shale oil, are recovered from the product recovery zone. If desired, retorting gases other than air can be used to cause the retorting zone to travel through the in situ retort.

The described embodiment of the invention is only considered to be illustrative of the inventive concept; the scope of the invention is not to be restricted to such embodiment. Various and numerous other arrangements may be devised by one. skilled in the art without departing from the spirit and scope of this invention. For example, in some in situ retorts, the horizontal cross section of the in situ retort can have other shapes, such as hexagonal or triangular, or in some cases even circular, depending on the size and shape of the subterranean oil shale formation. Further, the top and bottom of the in situ retort could have other than flat horizontal boundaries depending upon the circumstances. For example, a dome shaped top may be formed.

It is preferred that the in situ retort formed according to practice of this invention has its longitudinal dimension vertically oriented since pillar support of the overburden is provided. It will be apparent that the in situ retort can have other orientations with the preferred length to width ratios and void fractions. For example, in some embodiments the in situ retort may be tilted at an angle from vertical to more closely conform to the dip of the oil shale formation. As mentioned above, the end of the in situ retort may be domed, and in other embodiments it may be pyramidal to assist gas distribution. Many other modifications and variations will be apparent to one skilled in the art.

What is claimed is:

1. An in situ oil shale retort in a subterranean oil shale formation comprising:

a cavity in the subterranean oil shale formation having sides and containing a zone of fragmented oil shale formation having a void fraction in the range of from about 10 to 25 percent of the volume of the zone of fragmented oil shale formation, the cavity having an approximately rectangular horizontal cross section and a height in the range of from about two to five times the horizontal dimension of the longest side of the cavity;

means for introducing gas at the top of the cavity for advancing a retorting zone downwardly through the zone of fragmented oil shale formation in the cavity, wherein kerogen in fragmented oil shale formation in the retorting zone is converted to liquid and gaseous products; and means for recovering liquid and gaseous products from the bottom of the cavity.

2. An in situ oil shale retort as defined in claim 1 wherein the void fraction is about 15 percent of the volume of the zone of fragmented oil shale formation.

3. An in situ retort as defined in claim 1 wherein the void fraction is no more than about 20 percent of the volume of the zone of fragmented oil shale formation.

4. An in situ retort as defined in claim 1 wherein the retort has a height of less than about three times the horizontal dimension of the longest side of the cavity.

5. In an in situ oil shale retort in a subterranean oil shale formation, the in situ retort being in the form of a cavity in the oil shale formation having sides and containing a zone of fragmented oil shale formation, the in situ retort having gas access means for introducing gas at the top of the in situ retort and means for recovering liquid and gaseous products from the bottom, the improvement comprising in combination the cavity having an approximately rectangular horizontal cross section and having a height in the range of from about two to about five times the horizontal dimension of the longest side of the cavity and wherein the average void fraction of the zone of fragmented oil shale formation is in the range of from about 10 to 25 percent of the volume of the zone.

6. In an in situ retort as defined in claim 5 the further improvements wherein the cavity has an approximately square horizontal cross section and a height in the range of from about two to five times the width of the square cavity and the average void fraction of the zone of fragmented oil shale formation is about 15 percent of the volume of the zone.

7. In an in situ retort as defined in claim 6 the improvement wherein the cavity has a height less than about three times the horizontal dimension of the longest side of the cavity.

8. In an in situ retort in a subterranean oil shale formation, the in situ retort being in the form of a cavity in the oil shale formation containing a zone of fragmented oil shale formation, the in situ retort having gas access means for introducing gas at one end of the in situ retort and means for recovering liquid and gaseous products from the other end, the improvement comprising in combination the cavity having a height in the range of from about two to about five times the maximum horizontal dimension of the cavity and the zone of fragmented oil shale having an average void fraction in the range of from about 10 to 20 percent of the volume of the zone of fragmented oil shale formation.

9. A method for converting kerogen in a zone of fragmented oil shale formation to liquid and gaseous products in an in situ retort in a subterranean oil shale formation and recovering the products which comprises the steps of:

excavating subterranean oil shale formation to form open space in the volume of the subterranean oil shale formation to become an in situ retort, the open space having a volume in the range of from about 10 to 25 percent of the volume of the zone of fragmented oil shale formation to be formed in the in situ retort;

fragmenting the oil shale in the volume of the subterranean oil shale formation to become the in situ retort and expanding it into the open space to produce a zone of fragmented oil shale formation in the in situ oil shale retort, the zone having an approximately rectangular horizontal cross section and having a height in the range of about two to five times the horizontal dimension of the longest side of the horizontal cross section and an average void fraction in the range of from about 10 to 25 percent of the volume of the zone;

providing means for introducing gas at the top of the in situ retort;

providing means for recovering gaseous and liquid products from retorting fragmented oil shale formation at the bottom of the in situ retort;

igniting the top of the fragmented oil shale formation in the in situ retort for establishing a combustion zone;

introducing an oxygen supplying gas into the top of the in situ retort for advancing the combustion zone toward the bottom of the in situ retort and producing flue gas;

moving flue gas from the combustion zone through the fragmented oil shale on the advancing side of the combustion zone for establishing a retorting zone wherein kerogen in fragmented oil shale formation is converted to liquid and gaseous products; and recovering said products from the bottom of the in situ retort.

10. A method as defined in claim 9 wherein the excavating step comprises excavating subterranean oil shale formation to form open space having a volume of about 15 percent of the volume of the zone of fragmented oil shale formation to be formed in the in situ retort.

11. A method as defined in claim 9 wherein the average void fraction of the zone of fragmented oil shale formation is no more than about 20 percent of the volume of the zone.

12. A method as defined in claim 11 wherein the height of the zone of fragmented oil shale formation in the in situ retort is less than about three times the horizontal dimension of the longest side of the horizontal cross section of the zone.

13. A method as defined in claim 9 wherein the fragmenting and expanding step produces an in situ retort having a substantially square horizontal cross section.

14. A method for retorting oil shale in situ comprising the steps of:

forming an in situ retort having sides in a subterranean oil shale formation, said in situ retort having a height in the range of from about two to five times the horizontal dimension of the longest side of the retort and containing a zone of fragmented oil shale formation having an average void fraction in the range of from about 10 to 20 percent of the volume of the zone;

introducing a gas in one end of the in situ retort for advancing a retorting zone through the fragmented oil shale wherein kerogen in fragmented oil shale formation in the retorting zone is converted to liquid and gaseous products; and recovering the liquid and gaseous products at the other end of the in situ retort.

15. A method as defined in claim 14 wherein the forming step comprises forming the in situ retort with a height less than about three times the horizontal dimension of the longest side of the retort.

16. A method as defined in claim 14 wherein the forming step comprises forming the in situ retort with a substantially square horizontal cross section.

17. A method as defined in claim 14 wherein the forming step comprises forming the in situ retort with an average void fraction of the zone of fragmented oil shale formation of about 15 percent of the volume of the zone.

18. A subterranean in situ oil shale retort system comprising:

first and second vertically elongated in situ retorts, each of said retorts having a substantially rectangular horizontal cross section, and containing a zone of fragmented oil shale formation having a height in the range of from about two to five times the horizontal dimension of the longest side of the in situ retort;

said in situ retort system having a pillar of unfragmented oil shale separating the zones of fragmented oil shale formation in the first and second in situ retorts, the horizontal cross section of the pillar relative to its height being less than sufficient for supporting overburden over the first and second in situ retorts, each of said zones of fragmented oil shale formation having an average void volume in the range of from about 10 to 25 percent of the volume of the zone of fragmented oil shale formation for providing lateral support for the pillar for assisting in supporting the overburden;

means for introducing gas at the top of each in situ retort; and means for recovering liquid and gas at the bottom of each in situ retort.

19. An in situ oil shale retort system as defined in claim 18 wherein the average void volume of the zone of fragmented oil shale formation in each in situ retort is about 15% of the volume of the zone of fragmented oil shale formation in such in situ retort.

20. An in situ oil shale retort system as defined in claim 18 wherein the height of the zone of fragmented oil shale formation in each retort is less than about three times the horizontal dimension of the longest side of such zone and the average void fraction of each zone of fragmented oil shale formation is no more than about 20 percent of the volume of such zone.

* * * * *